United States Patent [19]

Schmanski

[11] Patent Number: 5,015,119

[45] Date of Patent: May 14, 1991

[54] VISION BLOCKING BARRIER

[76] Inventor: Donald W. Schmanski, 1301 Hot Springs Rd., Carson City, Nev. 89706

[21] Appl. No.: 405,858

[22] Filed: Sep. 11, 1989

[51] Int. Cl.[5] ..... E01F 9/06

[52] U.S. Cl. ..... 404/12; 404/9; 404/13; 404/10; 256/13.1

[58] Field of Search ..... 49/49, 57; 404/6, 9, 404/12, 10, 13; 256/1, 13.1

[56] References Cited

U.S. PATENT DOCUMENTS 4,062,522 12/1977 Lepetri ..... 256/1

4,338,041 6/1982 Schmanski ..... 256/13.1

FOREIGN PATENT DOCUMENTS 2584112 1/1987 France ..... 256/13.1

*Primary Examiner*—Ramon S. Britts

*Assistant Examiner*—Roger J. Schoeppel

*Attorney, Agent, or Firm*—Thorpe, North & Western

[57] ABSTRACT

A modular barrier for attachment to a barricade along a road side for substantially blocking vision toward construction zones or other areas of distracting activity. The barrier includes an elongated base plate with attached support posts which include mounting tracks for insertion of opaque panel members between adjacent posts. Panel edges are configured for tongue-in-groove insertion within channel tracks formed at the lateral sides of each support post. The modular construction of this unit enables quick and economical emplacement at construction areas and other sites where vehicle drivers are prone to distraction by off road activities.

9 Claims, 1 Drawing Sheet

VISION BLOCKING BARRIER

BACKGROUND OF THE INVENTION

1. Field of Invention:

This invention relates to devices which are positioned on barricades along a road side for obstructing view of a selected area. More specifically, the present invention relates to a screening barrier to prevent drivers of vehicles from having visual contact with construction areas and similar events which distract a driver from full attention to the road way.

2. Prior Art:

The increasing number of vehicles on roads and highways demands increasing attention to those circumstances and events which disrupt normal traffic flow patterns. Driving a vehicle has become almost a secondary reaction, to the extent to that the mechanics of controlling the vehicle are semi-automatic. This reaction has been enhanced by the tendency of traffic engineers to minimize road side distractions and maintain a substantially uniform road way environment.

In addition to the risk of inattentiveness while driving a vehicle, the foregoing environment creates an enhanced diversion reaction when a driver encounters an abnormal circumstance in the driving environment. For example, the occurrence of an accident or a construction zone often causes serious traffic slowdowns as a by-product of "rubber necking". This condition is a natural by-product of curiosity; however, it seems more acute in the highway environment because of its contrast with the typical mundane and uneventful circumstance. Accordingly, upon occurrence of something unexpected or unique, the driver often allows his mental tension to focus on the distracting event, rather than giving full attention to the control of his vehicle. These slow down conditions are even more frustrating for other drivers whose primary concern is maintenance of normal traffic speed, because the direct impact of rubber necking seems to generate a geometric progression in the rate of slow down somewhat proportional to the number of drivers who allow their attention to be diverted.

Although unexpected events such as accidents cannot be predicted and therefore allow little control of such traffic slow downs, construction zones are always known in advance and are appropriate subject matter for regulation of the disrupted traffic flow pattern arising from curious drivers who allow their attention to be diverted. Accordingly, prior art practices have included the construction of total visual barriers fabricated of plywood and framed at ground level or on top of a barricade. Unfortunately, such areas are also subject to inadvertent impact or collision with maintenance trucks and other vehicles. Such impact may easily break down the visual barrier and even send the large plywood panels hurling at some innocent bystander. In addition to their unsatisfactory safety performance, such wall constructions are cumbersome to assemble and expose the construction worker to a significant safety risk in view of moving traffic in the immediate vicinity.

In an effort to reduce the problem of rubber necking in high flow traffic areas, various forms of glare screen devices have been applied. For example, U.S. Pat. No. 4,338,041 illustrates a modular form of glare screen comprising a fiber reinforced plastic base rail with upright, light blocking paddles or blades coupled to the base rail by a metal clip. Although these and similar devices assist in reduction of headlight glare from ongoing vehicles, the spacial separation between the light blocking blades allows full visual access to the roadside construction or other distraction taking place. Therefore, use of glarescreen devices has not proven to effectively solved the problem of severe traffic slowdowns arising from curious drivers.

OBJECTS AND SUMMARY OF THE INVENTION

It is therefore an object of the present invention to provide a substantially full visual screen which blocks view of construction zones and similar distraction areas from passing drivers.

It is a further object of the present invention to provide a modular system for developing a visual barrier which thereby reduces the extent of risk for maintenance crews who position the barrier in place.

A still further object of this invention is to provide a visual barrier which is quickly constructed with individual, removable components so that both installation and subsequent repair can be accomplished in minimal time and with less risk of worker injury. These and other objects are realized in a modular barrier suitable for attachment at ground or to the top side of a barricade which is positioned along a roadside. The barrier comprises an elongated base plate having opposing upper and lower surfaces of flat configuration and including an elongate axis for orientation. A plurality of support posts having top and bottom ends and opposing side faces are attached to the upper surface of the base plate by attachment means which rigidly couple the bottom end of each post to the upper surface of the base plate. These posts are coupled at equal separation distances to form a linear array of vertical, parallel, equidistant posts having side faces oriented along the elongated axis and substantially in a common plane. A mounting track is formed within each of the side faces of the posts and configured to receive one of several opaque panel members which have side edges configured to slidably fit in a tongue-in-groove relationship within the side faces of the respective posts. Accordingly, the upright posts permit the quick assembly of a vision blocking wall which can be assembled or disassembled in a manner of minutes, and yet provide some uniformity and construction appearance.

Other objects and features of the present invention will be apparent to those skilled in the art in view of the following detailed description, taken in combination with the accompanying drawings.

DETAILED DESCRIPTION OF THE INVENTION

Figure 1:
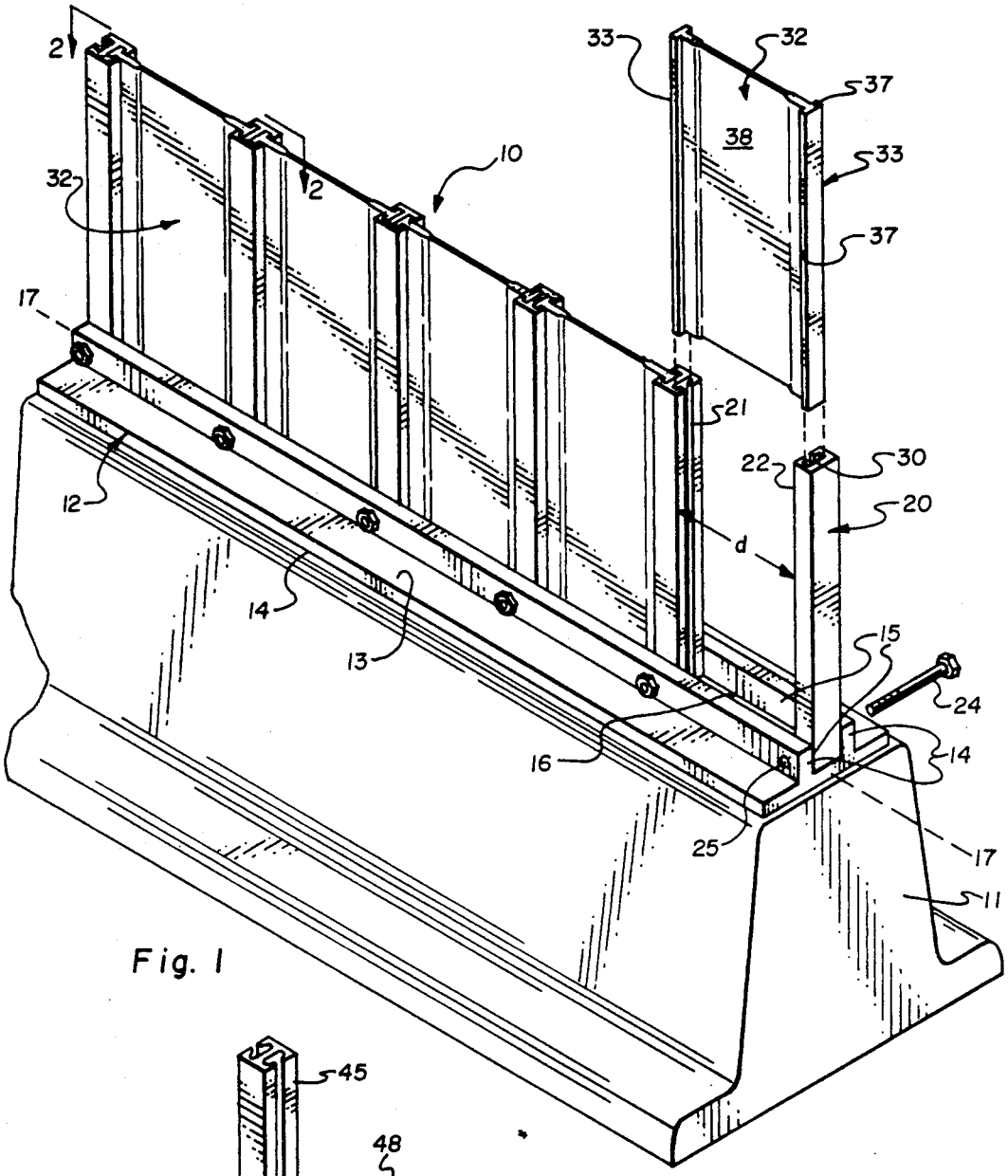
FIG. 1 shows a perspective view of the present invention mounted on a Jersey barricade with one of the opaque panels drawn in a removed position.

Referring now to the drawings:

FIG. 1 shows a modular barrier 10 constructed in accordance with the present invention and mounted at a top surface of Jersey barricade 11. Typically, such barricades are positioned at construction sites and other areas to restrict access of traffic and to provide some collision barrier. Because of the weight of such barricades, they provide an excellent base for attachment of the subject barrier. They also provide sufficient elevation so that a barrier 10 of approximately three feet in height can provide ample visual blockage to restrict sight of drivers seated in passenger vehicles. It will be apparent to those skilled in the art that the height of the subject barrier can be adjusted to meet the needs of any particular circumstance. The barrier illustrated in FIG. 1 is of shorter height for convenience in displaying the drawings. Normally this height would extend within the range of three to four feet of the top surface of the barricade 11.

The modular barrier 10 shown in FIG. 1 includes an elongated base plate 12 which has opposing upper 13 and lower 14 surfaces of flat configuration. This base plate 12 can be fabricated of any rigid material which is capable of supporting the remaining upright structure as will be explained hereafter. Typically, the preferred base plate would be pultruded as a composite of thermosetting resin and reinforcing fibers. The base plate could also be constructed of plastic compositions by an extruding process which also provides a uniform cross section along the length of the base plate.

In the embodiment illustrated in FIG. 1, the base plate includes a pair of outward projecting shoulders 14 which are integrally formed as part of the extruded or pultruded structure and extend as a uniform cross section along the length of the base 12. The interior faces 15 define a horizontal mounting slot 16 which extends along an elongated axis 17 of the base plate. The width of this slot is approximately equal to the width of a post 20 which is configured at its bottom end to be inserted within the slot 16.

The posts 20 are mounted vertically within slot 16 at equal separation distances D to form a linear array of vertical, parallel, equidistant posts 20 having side faces 21 and 22 oriented along the elongate axis 17 substantially in a common plane.

Each post 20 is locked in its vertical orientation within the mounting slot 16 by means of a friction pin 24 which fits tightly within an aligned opening 25 extending through the respective shoulders 14 and a base end of the post 20. Viewed collectively, the slot 16, shoulders 14 and mounting pin 24 form an attachment means which properly and rigidly positions the array of posts 20 in the vertical plane extending upward from the base plate 12.

Each post includes a mounting track 30 formed at the opposing side faces 21 and 22. This track is configured to slidably receive the side edges of panel members 32 in a tongue-in-groove relationship. In this manner, the panel members serve as removable components which can be inserted in the mounting tracks 30 of adjacent posts. Accordingly, each panel member 32 has its respective side edges 33 configured to fit in a tongue-in-groove relationship with the formed mounting track 30.

Figure 2:
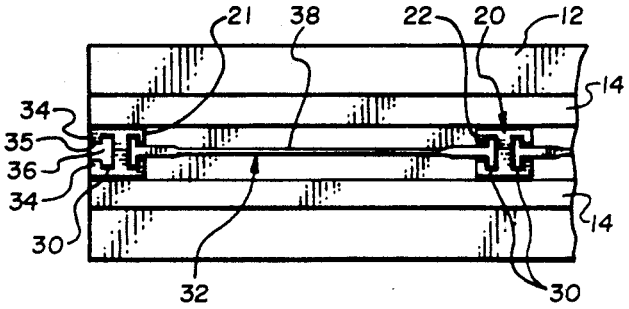
FIG. 2 shows a top view of a section of the modular barrier of FIG. 1, taken along the lines 2—2.

This relationship is shown more clearly in FIG. 2 wherein the mounting track comprises a channel recessed into the side faces of the respective posts and the panels 32 include flanged edges 33 which may be slidably inserted within the channel 30 of the mounting support post. This channel is formed with lateral flanges 34 which restrict the channel opening to a narrower width 35 than the channel body 36. The panel edges 33 are likewise configured with shoulder flanges 37 and 38 to fit within the channel body 30 as previously described. These flanges project from the web structure 38, which has a narrower thickness corresponding to the width of the narrow channel opening 35.

Both the posts 20 and opaque panels 32 have a uniform cross section which ideally suits them for fabrication by extrusion or pultrusion procedures. These structures are formed by use of a die which shapes the component with the desired channel or flanges on a continuous cross section basis. Accordingly, the channel 30 extends from the bottom of the post through the top end 40, enabling insertion of each panel 32 from a top side of the structure as illustrated in FIG. 1. Similarly, panels may be removed at will for replacement. The construction of these components in uniform cross sections enables rapid modular construction with a predictable fit. Whereas the longer base rail will typically be formed of reinforced fiber constructed by the pultrusion process, the upright posts 20 may easily be fabricated by extruding thermoplastic material through an appropriately configured die. Panel members 32 may be formed to be the thermoplastic or thermosetting resins, with or without reinforcing fibers.

Fabrication of the subject components in modular configuration with uniform cross sections facilitates preparation of barriers in a variety of dimensions. Typically, lengths of the elongated base are cut at 10, 12 and 14 feet. The opaque panels 32 are 9 and 9/16 inches in length, with the post being at 10 inches on center. Accordingly, a ten foot length of base plate would support 12 panels as configured in FIG. 1. Such lengths can be preassembled or assembled in the field with equal expediency. Emplacement procedures involve bolting or gluing the base plate 12 at a top surface of the barricade 11 in modular lengths to cover the distance of the construction site or other area to be visually blocked.

Figure 3:
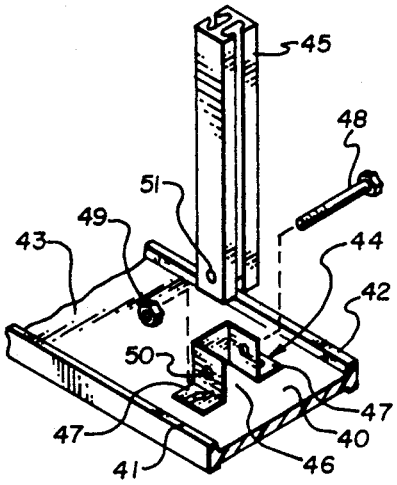
FIG. 3 shows an alternate embodiment of the present invention utilizing a separable bracket as mounting structure.

It will be apparent to those skilled in the art that the described embodiments are merely examples of the inventive concepts presented herein. FIG. 3, for example, illustrates a different embodiment of a modular barrier wherein the base rail 40 has a modified I-beam configuration with lateral support ribs 41 and 42. A central web portion 43 supports a metal bracket 44 which is configured to receive the support post 45 as illustrated. The metal bracket 44 is configured with a vertical slot 46 which is configured in size approximately equal to the bottom end of the post 45. A pair of base flanges 47 may be riveted or bolted to the web section 43 of the base plate. The support post 45 can merely be inserted within the receiving slot 46 and locked in place by means of a bolt 48 which is inserted through bracket openings 50 and a post opening 51 which are commonly aligned. Nut 49 is secured on the bolt to firmly fix the post 45 in the desired vertical orientation.

I claim:

1. A modular barrier for attachment to a top side of a barricade positioned along a roadside for substantially developing a total visual block for passing vehicular traffic, said barrier comprising:

an elongated base plate having opposing upper and lower surfaces of flat configuration and an elongate axis;

a plurality of support posts having top and bottom ends and opposing side surfaces;

attachment means comprising a pair of upward projecting elongate shoulders defining a horizontal mounting slot extending along the elongated axis of the base plate, said attachment means being rigidly coupled to the upper surface of the base plate and the bottom end of each post, the attachment means coupling the posts at equal separation distances along the upper surface of the base plate to form a linear array of vertical, parallel, equidistant posts, said posts having side faces being oriented along the elongate axis substantially along a common plane;

a plurality of opaque panel members, each having a width slightly greater than the separation distance between the side faces of the respective posts, each panel member having side edges of uniform cross-section and a top and bottom edge; and a mounting track formed at the opposing side faces of each post and configured to slidably receive the side edges of the panel members in a tongue-in-groove relationship to form a wall wherein the panel members serve as removable components in which the side edges thereof can be inserted in the mounting tracks of adjacent posts and the bottom edge can be inserted into the horizontal slot of the attachment means to form a total visual block barrier.

2. A modular barrier as defined in claim 1, wherein the base plate and support ports are of uniform cross-section.

3. A modular barrier as defined in claim 2, wherein the panel members are also of uniform cross-section.

4. A modular barrier as defined in claim 1, wherein the mounting track comprises a channel recessed into the side faces of the respective posts, said panel edges being configured to slidably fit within the channel.

5. A modular barrier as defined in claim 4, wherein the channel extends through the top end of the post to permit insertion and removal of the panel member after posts have been attached to the base plate.

6. A modular barrier as defined in claim 1, wherein the mounting track comprises a channel with lateral flanges restricting the channel opening to a narrower width than the channel body, said panel edges being configured with corresponding shoulder flanges sized to fit within the channel body, said narrower channel width being slightly larger than the thickness of the panel member.

7. A modular barrier as defined in claim 1, wherein said upward projecting elongate shoulders, said attachment means further comprising means for locking the post within the slot at proper spaced intervals in vertical orientation.

8. A modular barrier as defined in claim 7, wherein the locking means comprises (i) an aligned opening extending through the respective shoulders and inserted bottom end of the post and (ii) a friction pin configured to fit tightly within the aligned opening and across the respective shoulders.

9. A modular barrier for attachment to a top side of a barricade positioned along a road side for substantially developing a total visual block for passing vehicular traffic, said barrier comprising:

an elongated base plate having opposing upper and lower surfaces of flat configuration and an elongate axis;

a plurality of support posts having top and bottom ends and opposing side bases;

attachment means rigidly coupled to the upper surface of the base plate and the bottom end of each post, said attachment means coupling the posts at equal separation distances along the upper surface of the base plate to form a linear array of vertical, parallel, equidistance posts, said side faces of each post being oriented along the elongate axis substantially along a common plane, said attachment means comprising a including a base flange for attachment to the base plate;

a plurality of opaque panel members, each having a width slightly greater than the separation distance between the side faces of the respective posts, each panel member having side edges of uniform cross-section; and a mounting track formed at the opposing side faces of each post and configured to slidably receive the side edges of the panel members in a tongue-in-groove relationship to form a wall wherein the panel members serve as removable components which can be inserted in the mounting racks of adjacent posts to form a total visual lock barrier.

* * * * *